US010222726B2

(12) United States Patent
Shimizu

(10) Patent No.: US 10,222,726 B2
(45) Date of Patent: Mar. 5, 2019

(54) DEVELOPING DEVICE AND IMAGE FORMING APPARATUS INCLUDING THE SAME

(71) Applicant: KYOCERA Document Solutions Inc., Osaka (JP)

(72) Inventor: Tamotsu Shimizu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/851,371

(22) Filed: Dec. 21, 2017

(65) Prior Publication Data

US 2018/0203376 A1 Jul. 19, 2018

(30) Foreign Application Priority Data

Jan. 16, 2017 (JP) ..... 2017-004811

(51) Int. Cl.
*G03G 15/09* (2006.01)
*G03G 15/08* (2006.01)

(52) U.S. Cl.
CPC ..... *G03G 15/0928* (2013.01); *G03G 15/0812* (2013.01); *G03G 15/0818* (2013.01); *G03G 15/0893* (2013.01)

(58) Field of Classification Search
CPC ..... G03G 15/06; G03G 15/0806; G03G 15/0812; G03G 15/0818; G03G 15/09; G03G 15/0921; G03G 15/0928
USPC ..... 399/265, 267, 274, 276, 277, 286
See application file for complete search history.

(56) References Cited

U.S. PATENT DOCUMENTS

2012/0057907 A1* 3/2012 Taguchi ..... G03G 15/0818 399/276

FOREIGN PATENT DOCUMENTS

JP 2011-100003 A 5/2011

* cited by examiner

*Primary Examiner* — Benjamin R Schmitt
(74) *Attorney, Agent, or Firm* — Studebaker & Brackett PC

(57) ABSTRACT

A developing device includes a development roller, a layer-thickness limiting member, and a first screw. The development roller includes a fixed magnet and a sleeve. The first screw supplies developer to the development roller while conveying the developer in a first conveyance direction. The sleeve includes a plurality of recesses. Each of the recesses has an elongated shape, and a downstream end and an upstream end in the first conveyance direction. The downstream end is located farther downstream in a rotational direction of the sleeve than the upstream end. When the developer in each of the recesses passes the layer-thickness limiting member, the developer moves upstream in the first conveyance direction.

6 Claims, 7 Drawing Sheets

DEVELOPING DEVICE AND IMAGE FORMING APPARATUS INCLUDING THE SAME

INCORPORATION BY REFERENCE

The present application claims priority under 35 U.S.C. § 119 to Japanese Patent Application No. 2017-004811, filed on Jan. 16, 2017. The contents of this application are incorporated herein by reference in their entirety.

BACKGROUND

The present disclosure relates to a developing device and an image forming apparatus including the same.

An image forming apparatus such as a printer or a copier that employs electrography includes a photosensitive drum, a developing device, and a transfer device. The photosensitive drum carries an electrostatic latent image. The developing device supplies toner to the photosensitive drum and develops the electrostatic latent image into a toner image. The transfer device transfers the toner image formed on the photosensitive drum to a sheet.

The developing device includes a development roller which supplies toner to the photosensitive drum. The development roller includes a sleeve which encapsulates a fixed magnet. The fixed magnet includes a plurality of poles. The sleeve rotates around the fixed magnet. In the developing device that employs two-component development, developer including toner and a magnetic carrier is carried on the sleeve of the development roller.

An existing developing device includes a development roller which has a sleeve with a plurality of recesses formed on the peripheral surface thereof. In detail, the development roller is arranged so that each of the recesses extends in an axial direction of the development roller. Mutually adjacent recesses are arranged so as to not overlap with each other, and to connect with each other at ends thereof.

SUMMARY

A developing device according to an aspect of the present disclosure includes a housing, a development roller, a first conveyance member, and a layer-thickness limiting member. The housing houses developer that includes toner and magnetic carrier. The development roller supplies the toner to a photosensitive drum. The development roller includes a fixed magnet and a sleeve. The fixed magnet is fixed to the housing. The sleeve rotates in a predetermined rotational direction around the fixed magnet, and carries the developer on a surface of the sleeve. The first conveyance member is arranged opposite to the development roller in the housing, and conveys the developer in a first conveyance direction. The layer-thickness limiting member is arranged opposite to the sleeve in the housing. The layer-thickness limiting member limits thickness of the developer that is carried by the sleeve. The sleeve includes a plurality of recesses on a peripheral surface thereof. The recesses are arranged in predetermined intervals in circumferential and axial directions of the sleeve. Each of the recesses has an elongated shape. Each of the recesses has a downstream end and an upstream end in the first conveyance direction, and the downstream end is located farther downstream in the rotational direction of the sleeve than the upstream end.

An image forming apparatus according to another aspect of the present disclosure includes the above developing device, the photosensitive drum, and a transfer section. The photosensitive drum is supplied with the toner from the developing device and carries a toner image on a peripheral surface thereof. The transfer section transfers the toner image from the photosensitive drum to a sheet.

DETAILED DESCRIPTION

As follows, an image forming apparatus 10 according to an embodiment of the present disclosure is described in detail, based on the drawings. In the present embodiment, the image forming apparatus is a tandem color printer. Note that the image forming apparatus may also be a copier, a facsimile machine, a multifunction peripheral, or the like.

Figure 1:
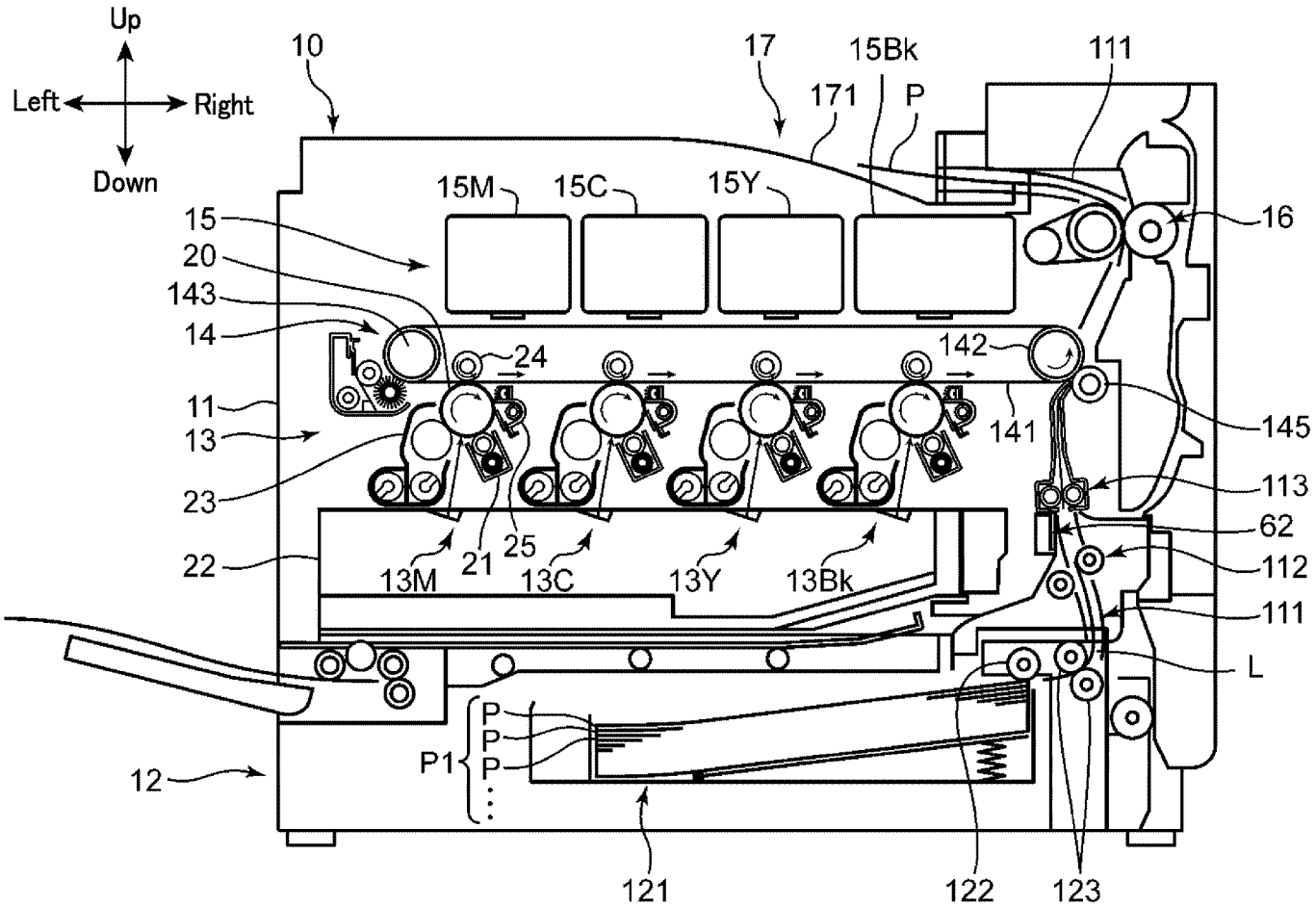
FIG. 1 is a schematic illustration of an internal configuration of an image forming apparatus according to an embodiment of the present disclosure.

FIG. 1 is a schematic illustration of an internal configuration of the image forming apparatus 10. The image forming apparatus 10 includes a main body 11 with a box-shaped casing structure. The image forming apparatus 10 further includes a sheet feed section 12, an image forming section 13, an intermediate transfer unit 14, a secondary transfer roller 145, a toner replenishing section 15, and a fixing section 16. The sheet feed section 12, the image forming section 13, the intermediate transfer unit 14, the secondary transfer roller 145, the toner replenishing section 15, and the fixing section 16 are housed inside of the main body 11. Additionally, the image forming apparatus 10 further includes a sheet ejection section 17 in an upper portion of the main body 11. The sheet ejection section 17 ejects a sheet P with fixing processing applied thereto by the fixing section 16.

The image forming apparatus 10 further includes a sheet conveyance section 111 inside the main body 11. The sheet conveyance section 111 conveys the sheet P. The sheet conveyance section 111 includes a pair of conveyance rollers 112 and a pair of registration rollers 113. The sheet conveyance section 111 is located to the right of the image forming section 13, and includes a sheet conveyance path L extending in an up-and-down direction. In the sheet conveyance path L, the sheet P is conveyed from the sheet feed section 12 to the sheet ejection section 17, via the image forming section 13 (a secondary transfer nip section) and the fixing section 16. The pair of conveyance rollers 112 is provided in an appropriate location on the sheet conveyance path L. The pair of registration rollers 113 corrects any skew of the sheet P and forwards the sheet P to the hereafter described secondary transfer nip section at a predetermined timing. The pair of registration rollers 113 is provided upstream of the secondary transfer nip section in a sheet conveyance direction of the sheet P.

The sheet feed section 12 feeds the sheet P. The sheet feed section 12 includes a paper feed tray 121, a pickup roller 122, and a pair of sheet feed rollers 123. The paper feed tray 121 is installed in a lower location of the main body 11 so as to be insertable and detachable, and stores a sheet sheaf P1 that is a stacked plurality of sheets P. The pickup roller 122 retrieves an uppermost sheet P one at a time from the sheet sheaf P1 stored in the paper feed tray 121. The pair of sheet feed rollers 123 forwards the sheet P retrieved by the pickup roller 122 to the sheet conveyance section 111.

The image forming section 13 forms a toner image that is transferred to the sheet P. In the present embodiment, the image forming section 13 includes four image forming units. The four image forming units respectively form toner images from four different colors. As follows, the four image forming units may be referred to as a "magenta toner unit 13M", a "cyan toner unit 13C", a "yellow toner unit 13Y", and a "black toner unit 13Bk". The magenta toner unit 13M forms a toner image using magenta (M) developer. The cyan toner unit 13C forms a toner image using cyan (C) developer. The yellow toner unit 13Y forms a toner image using yellow (Y) developer. The black toner unit 13Bk forms a toner image using black (Bk) developer. In the present embodiment, the magenta toner unit 13M, the cyan toner unit 13C, the yellow toner unit 13Y, and the black toner unit 13Bk are arranged in the stated order from upstream to downstream in a movement direction of a lower surface of a hereafter described intermediate transfer belt 141 (from left to right as illustrated in FIG. 1). Each of the units 13M, 13C, 13Y, and 13Bk includes a photosensitive drum 20, a charger 21, a developing device 23, and a cleaning device 25. The charger 21, the developing device 23, and the cleaning device 25 are arranged around the photosensitive drum 20. Also, the image forming apparatus 10 includes an exposure device 22. The exposure device 22 is arranged below the image forming units.

The photosensitive drum 20 is driven to rotate around an axis thereof, and an electrostatic latent image and a toner image are formed on a surface thereof. The charger 21 evenly charges the surface of the photosensitive drum 20. The charger 21 includes a charging roller and a charger cleaning brush for removing attached toner from the charging roller. The exposure device 22 includes a light source and various optical devices such as a polygon mirror, a reflecting mirror, a deflecting mirror. The exposure device 22 radiates light modulated based on image data to the photosensitive drum 20, thus forming an electrostatic latent image on the surface of the photosensitive drum 20. The cleaning device 25 cleans the surface of the photosensitive drum 20 after the toner image has been transferred.

The developing device 23 supplies toner to the photosensitive drum 20 to develop the electrostatic latent image formed on the photosensitive drum 20. In the present embodiment, the developing device 23 develops the electrostatic latent image formed on the photosensitive drum 20 using two-component developer. The two-component developer includes toner and carrier. Note that in the present embodiment, the toner is charged to a positive polarity.

Toner images formed by the image forming units 13M to 13Bk are transferred (primary transfer) to the intermediate transfer unit 14. The intermediate transfer unit 14 is arranged in a space provided between the image forming section 13 and the toner replenishing section 15. The intermediate transfer unit 14 includes the intermediate transfer belt 141, a drive roller 142, a driven roller 143, and four primary transfer rollers 24.

The toner images that were transferred to the intermediate transfer unit are transferred (secondary transfer) to the sheet P by the secondary transfer roller 145. The secondary transfer roller 145 is arranged opposite to the drive roller 142, with the intermediate transfer belt 141 interposed therebetween. The secondary transfer roller 145 is pressed against the peripheral surface of the intermediate transfer belt 141 to form the secondary transfer nip section. The primarily transferred toner images on the intermediate transfer belt 141 are transferred (secondary transfer) to the sheet P when the sheet P fed from the sheet feed section 12 passes through the secondary transfer nip section. The intermediate transfer unit 14 and the secondary transfer roller 145 of the present embodiment form a transfer section according to an aspect of the present disclosure. The transfer section transfers the toner images from the photosensitive drum 20 to the sheet P.

The toner replenishing section 15 replenishes toner to the image forming section 13. The toner replenishing section 15 stores toner used to form images. In the present embodiment, the toner replenishing section 15 includes four toner containers. As follows, the four toner containers may be respectively referred to as a "magenta toner container 15M", a "cyan toner container 15C", a "yellow toner container 15Y", and a "black toner container 15 Bk". The four toner containers 15M to 15 Bk replenish toner of respective colors to the developing devices 23 of the respective image forming units (units 13M, 13C, 13Y, and 13 Bk) through an unillustrated toner conveyance section.

After the toner images have been formed on the sheet P, the fixing section 16 fixes the unfixed toner images to the sheet P. The fixing section 16 includes a pressure member and a heating member arranged opposite to the pressure member. A fixing nip section is formed by the pressure member and the heating member. Heat and pressure are applied to the sheet P conveyed to the fixing section 16 by the sheet conveyance section 111 as the sheet P passes through the fixing nip section. Herewith, the toner images transferred to the sheet P in the secondary transfer nip section are fixed to the sheet P.

The sheet ejection section 17 ejects the sheet P on which fixing processing has been executed out of the main body 11. The sheet ejection section 17 includes an exit tray 171 formed externally to the main body 11. The exit tray 171 is formed by recessing the top of the main body 11. A bottom of the resulting recess functions as the exit tray 171.

Figure 2:
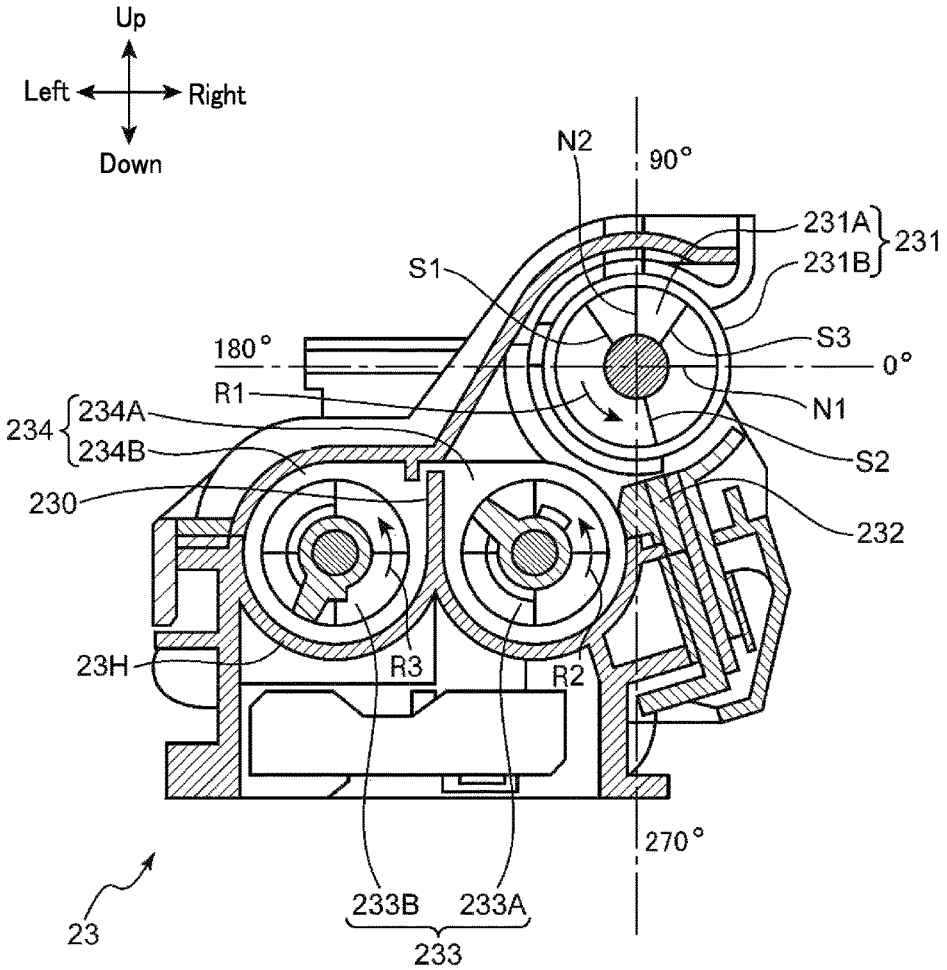
FIG. 2 is a schematic cross-sectional view illustrating an internal configuration of a developing device according to the embodiment of the present disclosure.
Figure 3:
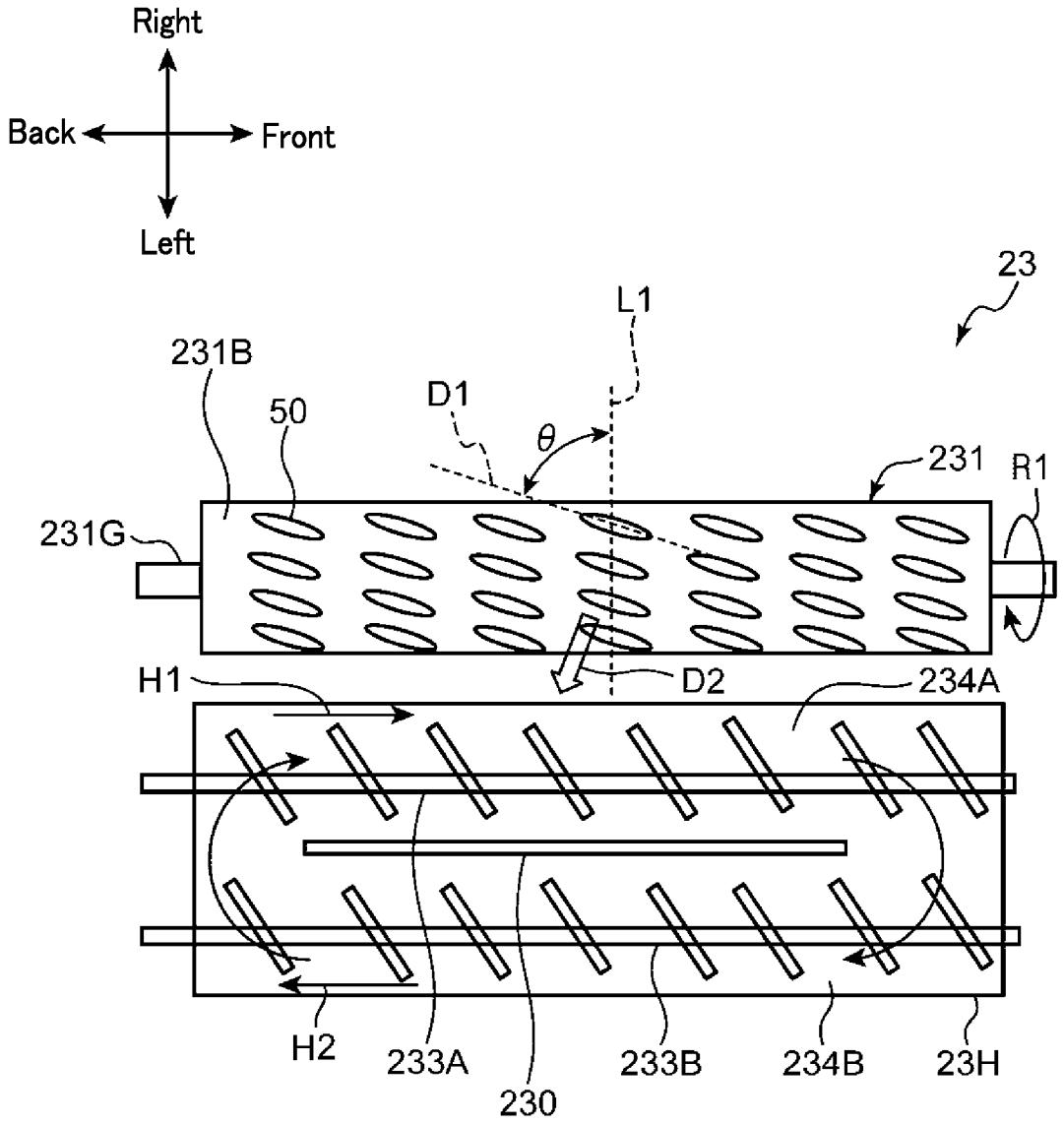
FIG. 3 is a schematic plan view illustrating the internal configuration of the developing device according to the embodiment of the present disclosure.
Figure 4:
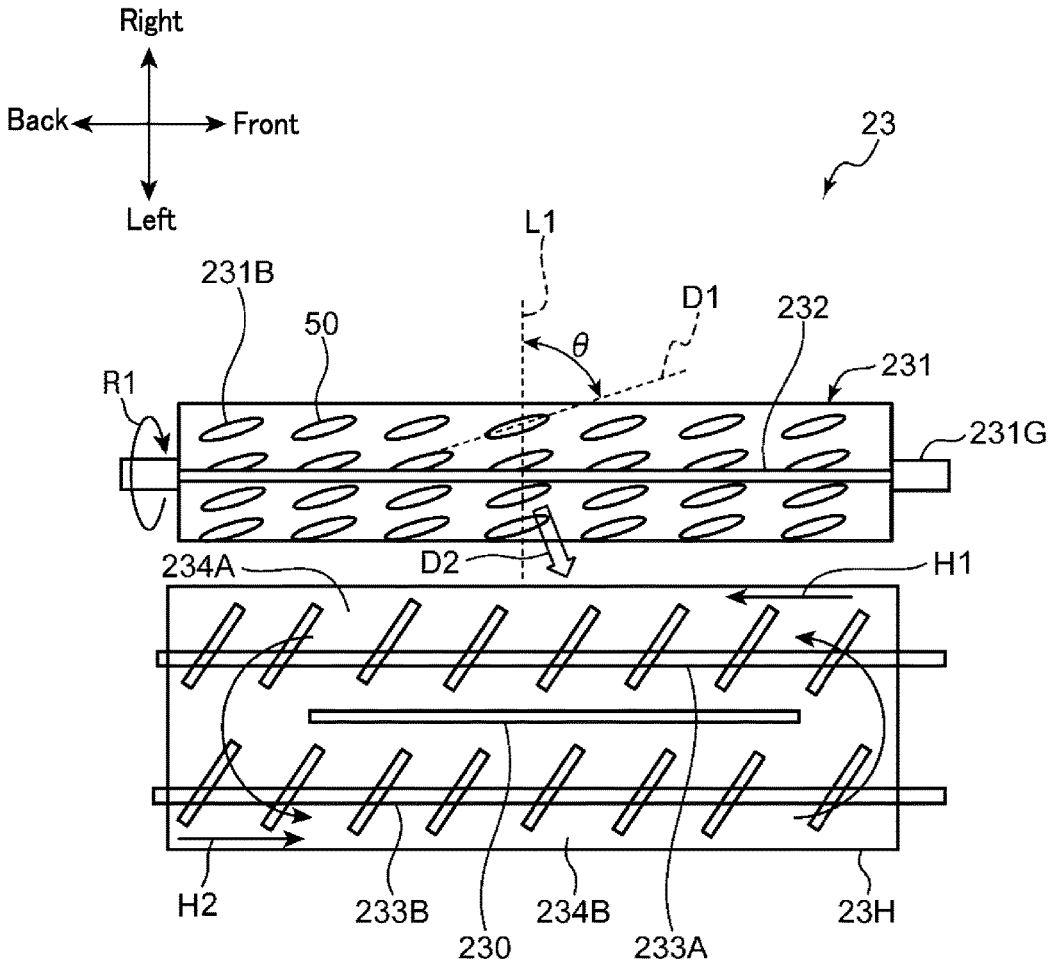
FIG. 4 is a transparent bottom view of the developing device illustrated in FIG. 2.

Next, the developing device 23 according to the present embodiment is further described with reference to FIGS. 2 and 3. FIG. 2 is a schematic cross-sectional view illustrating an internal configuration of the developing device 23 according to the present embodiment. FIG. 3 is a schematic plan view illustrating the internal configuration of the developing device 23. In detail, FIG. 3 is a top view of the developing device 23 illustrated in FIG. 2. FIG. 4 is a transparent bottom view of the developing device 23 illustrated in FIG. 2.

As illustrated in FIG. 2, the developing device 23 includes a housing 23H, a development roller 231, a layer-thickness limiting member 232, stirring screws 233, and a developer conveyance section 234. The housing 23H is a casing portion that supports each member of the developing device 23. The housing 23H houses the developer that includes toner and magnetic carrier.

The development roller 231 is arranged opposite to the photosensitive drum 20. In detail, the development roller 231 is supported by the housing 23H so as to be opposite to the photosensitive drum 20. The development roller 231 forms a development nip section with the photosensitive drum 20. The development roller 231 rotates in a first rotational direction R1. In the present embodiment, the development roller 231 rotates in the same direction (hereinafter referred to as a trailing direction) as the photosensitive drum 20 in the development nip section. The development roller 231 supplies toner to the photosensitive drum 20 (refer to FIG. 1) through application of a developer bias with an alternating-current (AC) bias superimposed on a direct-current (DC) bias. The development roller 231 includes a fixed magnet 231A and a sleeve 231B. Note that a location on the development roller 231 with the shortest distance to the photosensitive drum 20 may be referred to as a "development location".

The fixed magnet 231A is a cylindrical magnet. The fixed magnet 231A is fixed to the housing 23H. The fixed magnet 231A includes five magnetic poles. In detail, the fixed magnet 231A includes three S-poles (S1 to S3) and two N-poles (N1 and N2). In the following, the three S-poles may be respectively referred to as "S1 pole", "S2 pole", and "S3 pole". Also, the two N-poles may be respectively referred to as "N1 pole" and "N2 pole". The five magnetic poles are arranged adjacent to each other in the circumferential direction of the development roller 231.

The sleeve 231B rotates around the fixed magnet 231A in the first rotational direction R1. The sleeve 231B carries developer including toner and magnetic carrier (forms a magnetic brush) on a surface thereof. In the present embodiment, the sleeve 231B is made from a circular aluminum pipe member.

The layer-thickness limiting member 232 is a plate member made from a non-magnetic metal. The layer-thickness limiting member 232 is arranged below the development roller 231, opposite to the sleeve 231B. The layer-thickness limiting member 232 limits thickness of the developer supplied by the sleeve 231B. Note that in another embodiment, a magnetic member may be fixed to a surface of the layer-thickness limiting member 232, the surface being upstream in the first rotational direction R1 from a location opposite to the development roller 231.

The stirring screws 233 cyclically convey the two-component developer while stirring the two-component developer, thus charging the toner. The stirring screws 233 include a first screw 233A (first conveyance member) and a second screw 233B (second conveyance member). The first screw 233A and the second screw 233B are supported by the housing 23H so as to rotate. In detail, the first screw 233A rotates in a second rotational direction R2, and the second screw 233B rotates in a third rotational direction R3. Also, the first screw 233A and the second screw 233B have a screw shape including a helical blade around a shaft thereof.

The developer conveyance section 234 forms a circulation path for the developer (developer conveyance path) inside of the housing 23H. The developer conveyance path includes a first conveyance path 234A and a second conveyance path 234B. The first screw 233A is arranged in the first conveyance path 234A. The second screw 233B is arranged in the second conveyance path 234B. As illustrated in FIGS. 3 and 4, the first and second conveyance paths 234A and 234B are partitioned from each other by a plate-shaped partitioning member 230 (partitioning plate). The first and second conveyance paths 234A and 234B are in communication with each other on both axial ends of the first and second screws 233A and 233B in an axial direction. The developer is conveyed along the first conveyance path 234A in a first conveyance direction H1 by the first screw 233A. The first conveyance direction H1 coincides with the axial direction of the first screw 233A. Also, the developer is conveyed along the second conveyance path 234B in a second conveyance direction H2 by the second screw 233B. The second conveyance direction H2 is counter to the first conveyance direction H1. As a result, the developer is cyclically conveyed between the first and second conveyance members 234A and 234B. Also, the toner replenished from the toner replenishing section 15 is inlet into the housing 23H from one end in the axial direction of the second screw 233B in the second conveyance path 234B, and mixed with the developer.

Also, as illustrated in FIG. 2, the developer that was cyclically conveyed by the stirring screws 233 is supplied to the development roller 231 (sleeve 231B) by the first screw 233A. The thickness of the developer supplied to the sleeve 231B is limited by the layer-thickness limiting member 232. Thereafter, a portion of the toner is supplied to the photosensitive drum 20 in the development nip section. Thereafter, the developer on the sleeve 231B is separated from the sleeve 231B and collected by the first screw 233A. The collected developer is inlet to the first conveyance path 234A.

Continuing, the fixed magnet 231A included in the development roller 231 is described with reference to FIG. 2. As illustrated in FIG. 2, the N1 pole is arranged so as to be opposite to the photosensitive drum 20, and functions as a main pole that supplies toner to the photosensitive drum 20. The S3 and N2 poles function as conveyance poles to collect developer that has passed the photosensitive drum 20 and return the developer into the housing 23H. The S1 pole functions as a separation pole (detachment pole) that separates the developer from the sleeve 231B. The S2 pole functions as a scooping pole to supply developer that was scooped up by the first screw 233A to the development roller 231. The S2 pole also functions as a restriction pole (restriction magnetic pole) that limits the thickness of the developer with the layer-thickness limiting member 232. Note that in FIG. 2, angular coordinates centered on the axis of the development roller 231 are displayed to indicate the arrangement of each magnetic pole.

Next, the configuration of the sleeve 231B according to the present embodiment is further described with reference to FIGS. 3 to 6. Note that in FIG. 3, a standard plane that is orthogonal to a rotary shaft 231G of the sleeve 231B (a plane including the rotational direction of the sleeve 231B) is indicated by a straight line L1, and an extending direction of recesses 50 is indicated by a straight line D1. In the present embodiment, the sleeve 231B has a plurality of the recesses 50 on the peripheral surface thereof. The recesses 50 are arranged in predetermined intervals in the circumferential and axial directions of the sleeve 231B (development roller 231). Note that the recesses 50 are arranged so as to be opposite to an unillustrated image forming area on the photosensitive drum 20.

Each recess 50 as illustrated in FIGS. 3 and 4 has an elongated shape extending in a predetermined direction D1.

Figure 5:
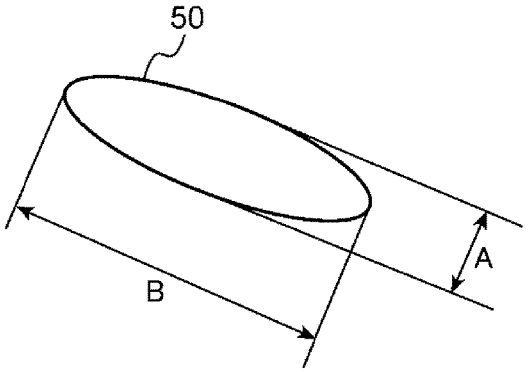
FIG. 5 is a diagram illustrating a recess on a sleeve of a development roller according to the embodiment of the present disclosure.

In the following, the extending direction of the recesses 50 is referred to as an "extending direction D1". In the present embodiment, each recess 50 has an elliptical shape. FIG. 5 is a diagram illustrating a single recess 50. In FIG. 5, a short diameter of the recess 50 is indicated by A, and a long diameter is indicated by B. The long diameter B coincides with the extending direction D1. As illustrated in FIG. 3, each of the recesses 50 has a downstream end and an upstream end in the first conveyance direction H1, and the downstream end is located farther downstream in the first rotational direction R1 of the sleeve 231B than the upstream end. In other words, the extending direction D1 is inclined so that the front end thereof descends with respect to an axial direction of the rotary shaft 231G of the sleeve 231B. In the present embodiment, the extending direction D1 is set so that an angle θ between the standard plane L1 and the extending direction D1 on the peripheral surface of the sleeve 231B is within a range of $45° \leq \theta < 85°$. Note that as referenced hereafter, the extending direction D1 is more preferably established so that the angle θ is within a range of $60° \leq \theta < 80°$.

In a configuration in which the recesses 50 are formed on the peripheral surface of the sleeve 231B as in the present embodiment, projected or recessed portions of the peripheral surface are less likely to be smoothed out, as compared to a sleeve that has a predetermined surface roughness produced by blast processing. Also, the magnetic brush of the developer is inhibited from concentrating in groove portions and is less likely to become rough, as compared to a sleeve with a plurality of grooves extending in the axial direction of the sleeve. As a result, over a long period, a fine-textured magnetic brush is stably formed.

Additionally, the sleeve 231B according to the present embodiment includes a function that ensures a charge amount of the developer that is cyclically conveyed through the developer conveyance section 234. Normally, toner that is newly replenished into the housing 23H (replenishment toner) is mixed and stirred in the second conveyance path 234B by the second screw 233B and supplied to the development roller 231 by the first screw 233A after passing through the first conveyance path 234A. However, when a large amount of toner is supplied, or components of the toner adhere to the carrier surface due to a long period of use and electrical charging performance of the carrier decreases, the replenished toner may not be charged sufficiently by the second screw 233B. In this case, the first screw 233A needs to further electrically charge the insufficiently charged toner. The charge amount of the toner may also increase in the environs of the layer-thickness limiting member 232 (limiting area).

Therefore, in the present embodiment, the developer on the sleeve 231B is conveyed in the axial direction of the development roller 231 by rotation of the sleeve 231B because of the slanting of each recess 50 with respect to the axial direction. In particular, a feature of the present embodiment is that a direction in which the developer moves on the sleeve 231B is counter to the first conveyance direction H1 in which the first screw 233A conveys the developer.

In detail, as illustrated in FIGS. 2 and 3, the developer supplied to the first conveyance path 234A from the second conveyance path 234B is subsequently supplied to the sleeve 231B by the first screw 233A and conveyed to the development nip section (development area) opposite to the photosensitive drum 20. In the present embodiment, as described above, the recesses 50 are formed on the peripheral surface of the sleeve 231B. Each recess 50 is arranged inclined with respect to the axial direction. Herewith, the developer is conveyed in the circumferential direction on the sleeve 231B, and is conveyed in the axial direction of the development roller 231 and counter to the conveyance direction of the developer conveyed by the first screw 233A (first conveyance direction H1). In other words, the developer is conveyed in the first conveyance direction H1 by the first screw 233A, slightly pushed back on the development roller 231 in a push-back direction D2 illustrated in FIGS. 3 and 4, and then conveyed in the first conveyance direction H1 through the first conveyance path 234A. As a result, the developer has a greater chance of being stirred by the first screw 233A in the environs of the first screw 233A and the layer-thickness limiting member 232. Accordingly, the charge amount of the toner is stably maintained, and occurrence of fogging or scattering of toner can be greatly decreased.

Figure 6:
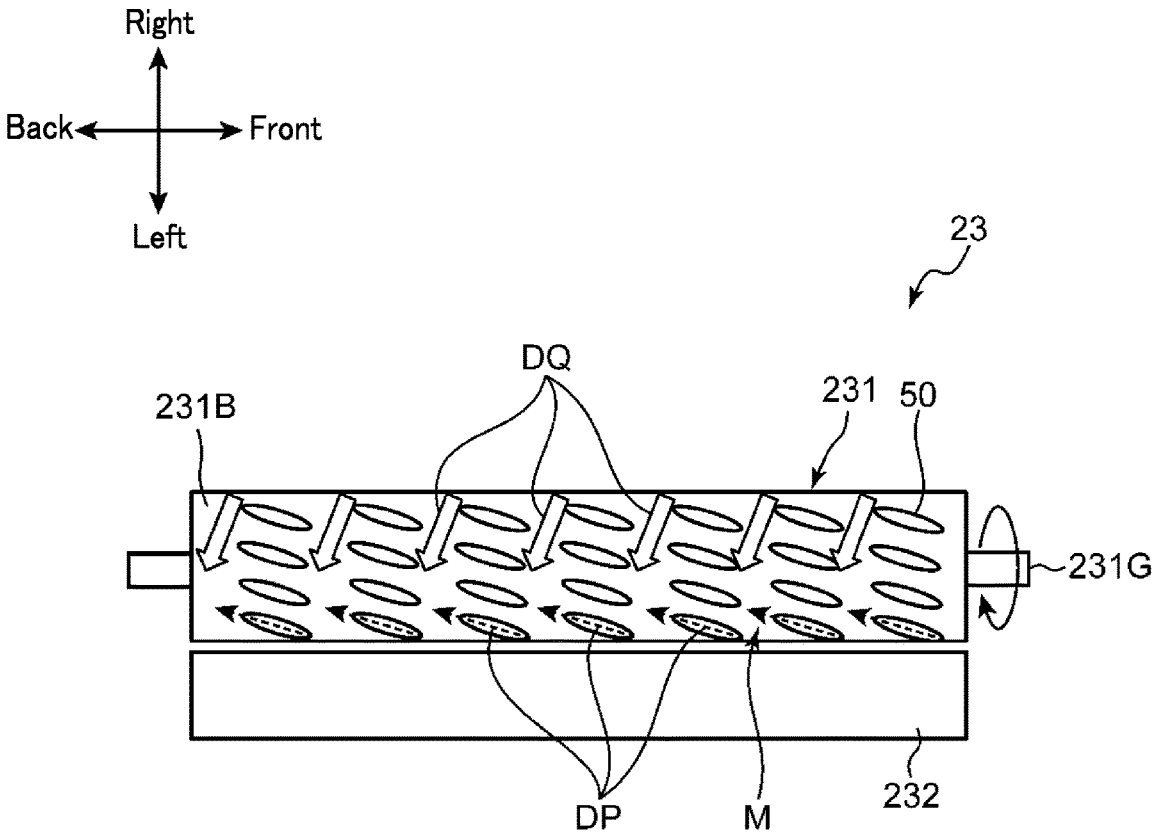
FIG. 6 is a schematic illustration of a flow of developer on the sleeve of the development roller according to the embodiment of the present disclosure.

FIG. 6 is a schematic illustration of a flow of the developer on the sleeve 231B of the development roller 231 according to the present embodiment. In detail, FIG. 6 is a diagram illustrating the development roller 231 as viewed from the photosensitive drum 20. As illustrated in FIG. 6, in the present embodiment, the sleeve 231B has areas M (surface of the sleeve 231B) extending from the recesses 50 in the extending direction D1. In other words, the sleeve 231B has predetermined intervals in the axial direction and the circumferential direction of the development roller 231 between mutually adjacent recesses 50. The areas M are located farther outside the sleeve 231B in a radial direction than the lower surfaces of the recesses 50 (located further from the restriction pole S2 (refer to FIG. 2) than the lower surfaces of the recesses 50). In this manner, the following phenomenon occurs on the surface of the sleeve 231B that has the recesses 50 formed therein. On the sleeve 231B, a developer layer is formed mainly in the recesses 50. That is, most of the developer is trapped in the recesses 50. The developer, being mostly trapped in the recesses 50, is conveyed in the circumferential direction of the development roller 231 to the development nip section from the first screw 233A via the layer-thickness limiting member 232, by the rotation of the sleeve 231B. Then, when the developer reaches the layer-thickness limiting member 232, the developer is pushed out of the recesses 50 in the extending direction D1 to the areas M by effects of the restriction pole S2 and the layer-thickness limiting member 232 described with reference to FIG. 2. That is, the developer in the recesses 50 is pushed out towards the areas M such that the developer is scraped off by the layer-thickness limiting member 232 (arrow DP in FIG. 6). When the entirety of the development roller 231 is viewed, the developer behaves such that it appears that the developer moves upstream in the first conveyance direction H1 (arrow DQ in FIG. 6) as the sleeve 231B rotates.

Note that the developer that has been pushed out along the recesses 50 is detached from the development roller 231 in the areas M, even in the environs of the separation pole S1 (refer to FIG. 2). The areas M allow the developer to be easily separated because surface roughness thereof is less than surface roughness within the recesses 50.

Additionally, congestion of agglomerated developer or other material between the layer-thickness limiting member 232 and the sleeve 231B is inhibited by the inclination of the recesses 50. As described with reference to FIG. 6, in the present embodiment, each recess 50 is arranged with an inclination. Because of this, when the sleeve 231B rotates, conveyance force is applied to the developer in the axial direction of the development roller 231. As a result, even if agglomerated developer or other materials become congested between the layer-thickness limiting member 232 and the sleeve 231B, the agglomerated developer or other material can be sent out in the axial direction of the development roller 231. Therefore, the agglomerated developer or other materials congested between the layer-thickness limiting member 232 and the sleeve 231B are easily detached from the areas M by small conveyance force, after being pushed out to the areas M in the arrow DP direction in FIG. 6 along the recesses 50.

Figure 7:
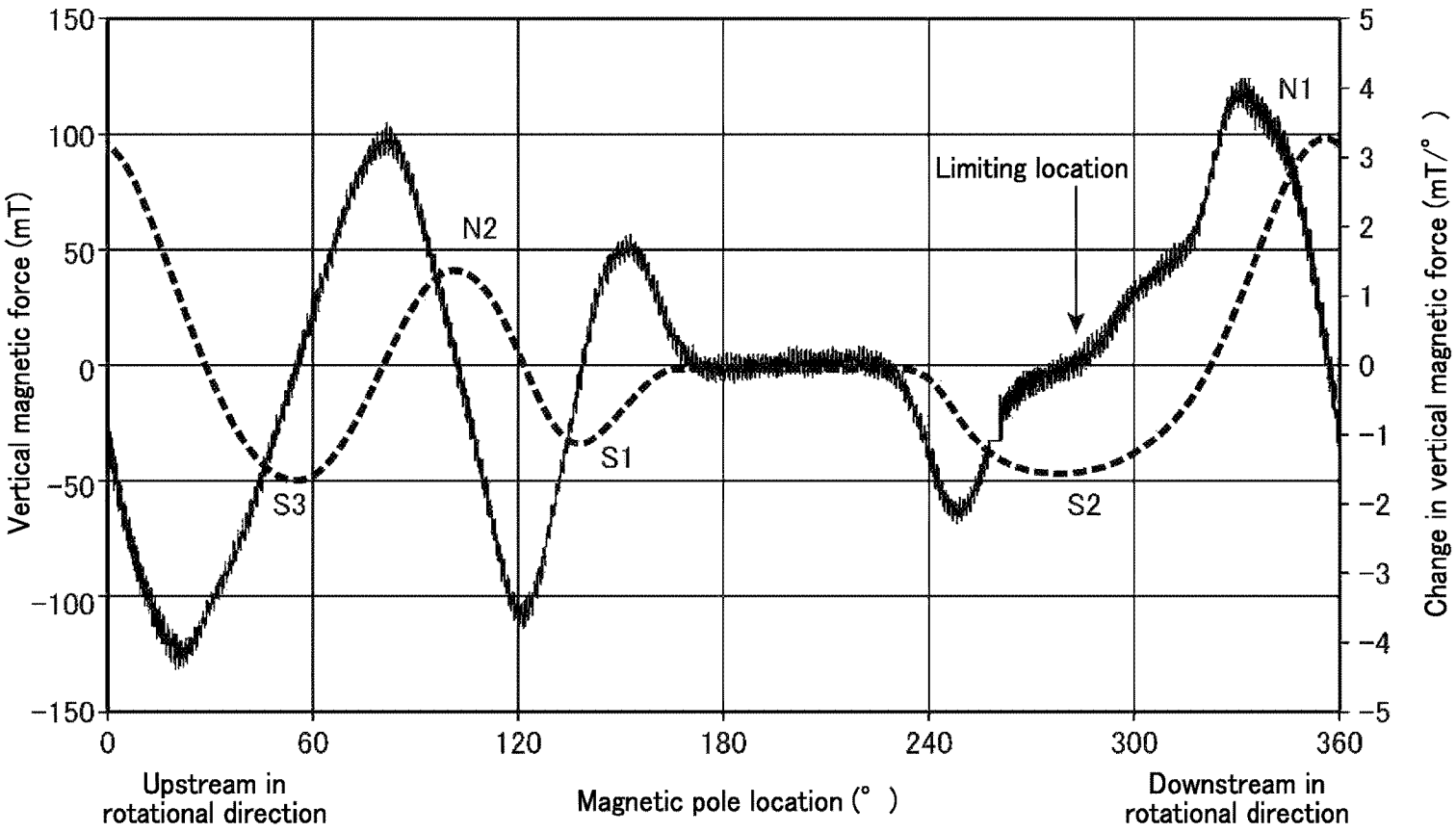
FIG. 7 is a graph illustrating magnetic force distribution of a fixed magnet of the development roller according to the embodiment of the present disclosure.

Additionally, in the present embodiment, the amount of change in the vertical direction component of the magnetic force of the S2 pole (restriction magnetic pole) is set to at most 0.5 (mT/°). This change in an area from a side of the layer-thickness limiting member 232 that is upstream in the rotational direction of the sleeve 231B (first rotational direction R1) to a point that is 10° farther upstream in the first rotational direction R1. Note that the above-mentioned amount of change means an absolute value of the amount of change in the magnetic force, calculated at angles of 0.02° increments. FIG. 7 is a graph indicating magnetic force distribution of the vertical direction component of the fixed magnet 231A of the development roller 231 according to the present embodiment. In FIG. 7, a dotted line indicates the magnetic force in a vertical direction, and a solid line indicates the amount of change in the magnetic force.

In order to move the developer on the surface of the sleeve 231B in the axial direction of the development roller 231, it is preferable to consider not only the shape of the recesses 50 on the sleeve 231B but also the influence of a magnetic field of the S2 pole of the fixed magnet 231A. The developer on the surface of the sleeve 231B is restrained in the vertical direction (radial direction) by the magnetic force of the S2 pole. Because of this, the entirety of the developer may not easily move along the recesses 50. Therefore, it is preferable for the restraining force of the S2 pole to be low in an area opposite to the layer-thickness limiting member 232. In the present embodiment, it is possible for attracting force or magnetic suction on the developer to be curbed by setting a rate of change in the vertical direction component of the magnetic force of the S2 pole as small. In the present embodiment, the magnetic brush (developer) was found to move easily in the recesses 50 when the rate of change in the vertical direction component of the magnetic force was no greater than 0.5 (mT/°), in results of repeated testing.

Figure 9:
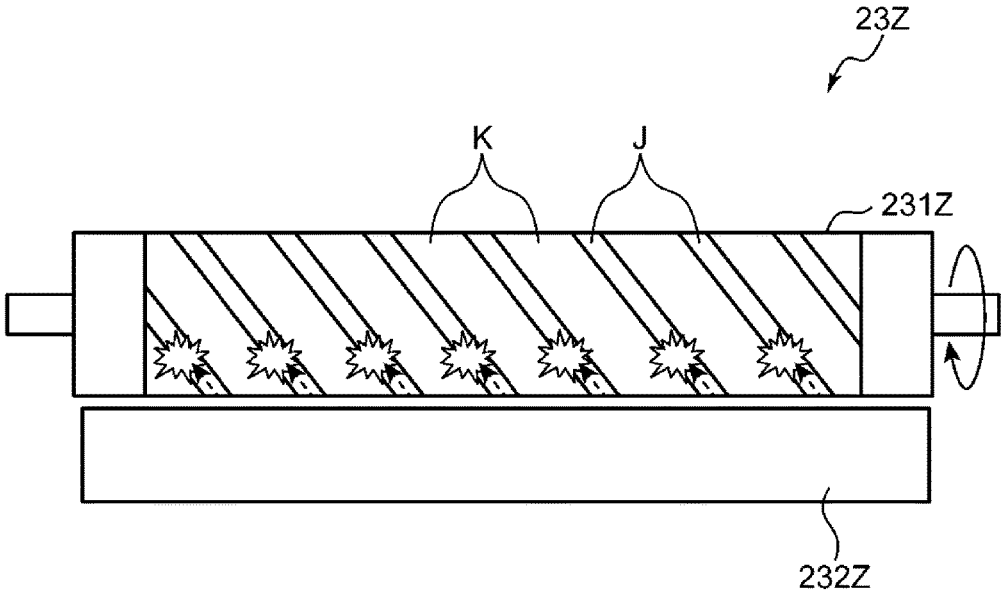
FIG. 9 is a schematic illustration of a flow of developer on the sleeve of another development roller, as compared with the development roller according to the embodiment of the present disclosure.

FIG. 9 is a schematic illustration of a flow of the developer on a sleeve 231Z of another development roller 23Z as compared to the development roller 231 according to the present embodiment. In the sleeve 231Z, a plurality of grooves J slanting at a predetermined angle with respect to an axial direction of the development roller 23Z is formed at predetermined intervals in the axial direction of the development roller 23Z. Between the mutually adjacent grooves J, an outer surface K of the sleeve 231Z is exposed. Also, the grooves J form single continuously extending groove portions. Because of this, the outer surface K of the sleeve 231Z excludes extended lines in a direction in which the grooves J extend. Therefore, there is always developer inside the grooves J. Because of this, adjacent developer particles collide, making it difficult for the developer to move along the grooves J even if the layer-thickness limiting member 232Z attempts to push the developer out of the grooves J. Also, because the developer is uniformly distributed in the grooves J, the developer cannot move along the grooves J even in a separation area (environs of the separation pole). Therefore, it is difficult for the separation poles to stably separate the developer from inside the grooves J.

The present embodiment is described above. According to the present embodiment, the sleeve 231B includes the recesses 50. Each of the recesses 50 carries developer. Therefore, the sleeve 231B has high conveying ability.

Also, in the present embodiment, the angle θ between the standard plane L1 orthogonal to the axial direction of the development roller 231 and the extending direction D1 in which each recess 50 extends on the peripheral surface of the sleeve 231B is set within a range of 45°≤θ<85°. Herewith, the developer on the sleeve 231B can stably move upstream in the first conveyance direction H1. As a result, the charge amount of the toner can be more stably maintained. Therefore, it is possible to stably supply toner with an ensured charge amount to the photosensitive drum 20, and a stabilized image can be formed.

Example

Next, the present disclosure is further described based on an example. Experiments were conducted under the following experimental conditions.

(Common Experimental Conditions)

Photosensitive drum 20: amorphous silicon (α-Si) photosensitive member, surface potential (white background portion) voltage=+250 to +300 V, (image portion) voltage=+20 V Printing speed: 55 sheets/minute.

Developer conveyance amount on development roller 231 (after layer-thickness limiting): 200 to 400 g/m$^2$ Carrier: volume median diameter of 35 μm, ferrite resin-coated carrier Toner: volume median diameter of 6.8 μm (positive chargeability)

Peripheral speed ratio of development roller 231 to photosensitive drum 20: 1.4 to 2.0 (trailing direction)

Gap between development roller 231 and photosensitive drum 20: 250 to 400 μm Development bias: DC bias=350V, AC bias=voltage point-to-point (Vpp) 1.2 kV, frequency f=3.7 kHz, duty=50%, square wave (note that the layer-thickness limiting member 232 had the same potential as the development roller 231)

(Sleeve Conditions)

In the present experiment, the following four types of sleeves were used.

Note that the fixed magnet 231A arranged inside each sleeve included the magnetic poles illustrated in FIG. 2.

Recessed sleeve (Examples 1 to 10): outer diameter: 20 mm, concave shape (In FIG. 5: A=0.8 mm, B=0.2 mm, 80 circumferential columns, 240 axial rows)

Blasted sleeve (Comparative Example 1): outer diameter 20 mm, sandblasted (RzJIS=7.4 μm)

Grooved sleeve (Comparative Example 2): outer diameter 20 mm, knurled grooves (axial direction), groove count 120, groove depth 80 μm, groove width 0.2 mm, V shape Slant-grooved sleeve (Comparative Example 3): outer diameter 20 mm, knurled grooves (60°≤angle θ<80°), groove count 120, groove depth 80 μm, groove width 0.2 mm Table 1 indicates evaluation results for each of the following aspects: "half-tone image", "decrease in image density", and "congestion in limiting area", under each experimental condition. Note that in Examples 1 to 5, a maximum value of magnetic force change rate of the previously described restriction pole magnetic force (S2 pole in FIG. 2) was set as at most 0.5)(mT/°. In Examples 6 to 10, the maximum value of the magnetic force change rate was set within a range of greater than 0.5 (mT/°).

TABLE 1

| | Sleeve surface shape | Maximum limiting magnetic force change rate value (mT/°) | Recess (groove) angle θ (°) | Half-tone | Decrease in image density | Congestion in limiting area |
|---|---|---|---|---|---|---|
| Example 1 | Recessed | Over 0.5 | 85 ≤ θ < 90 | G | G | P |
| Example 2 | | | 80 ≤ θ < 85 | G | G | M |
| Example 3 | | | 60 ≤ θ < 80 | G | G | M |
| Example 4 | | | 45 ≤ θ < 60 | G - M | G | M |
| Example 5 | | | 0 < θ < 45 | M | G | M |
| Example 6 | | Less than or equal to 0.5 | 85 ≤ θ < 90 | G | G | P |
| Example 7 | | | 80 ≤ θ < 85 | G | G | G - M |
| Example 8 | | | 60 ≤ θ < 80 | G | G | G |
| Example 9 | | | 45 ≤ θ < 60 | G - M | G | G |
| Example 10 | | | 0 < θ < 45 | M | G | G |
| Comparative Example 1 | Blasted | Less than or equal to 0.5 | — | G | P | P |
| Comparative Example 2 | Grooved | Less than or equal to 0.5 | — | P | G | M |
| Comparative Example 3 | Slant-grooved | Less than or equal to 0.5 | 60 ≤ θ < 80 | P | G | G - M |

Also, in Table 1, fineness of the half-tone image was evaluated visually and assigned at least one of three levels: "good" (G), "mediocre" (M), or "poor" (P). The occurrence of "decrease in image density" in a durability test of a predetermined number of printed sheets was evaluated as G (no occurrence) or P (occurrence). Additionally, congestion in the limiting area was evaluated at three levels: G (no lines on the sleeve), M (few lines of congestion but no problems on the image), or P (lines of congestion evident on the image).

In Examples 1 to 10 in Table 1, the experiment resulted in the half-tone image being favorably maintained and a decrease in density due to insufficient charging of the toner not occurring because the sleeve included the recesses 50, according to an aspect of the present disclosure. Note that in the blasted sleeve of Comparative Example 1, a decrease in image density due to insufficient charging occurred, although the half-tone image was favorable. Also, in the grooved sleeve of Comparative Example 2 and the slant-grooved sleeve of Comparative Example 3, a decrease in density did not occur because the conveying ability was high, but the half-tone image degraded because the magnetic brush of the developer was course.

Additionally, as in Examples 2 to 4 and 7 to 9, when the angle θ of the recesses 50 was set within a range of 45°≤θ<85°, the respective aspects of the half-tone image, the decrease in image density, and the congestion in the limiting area showed suitably compatible results. In addition, as in Examples 3 and 8, when the angle θ of the recesses 50 was set within a range of 60°≤0<80°, the respective aspects of the half-tone image, the decrease in image density, and the congestion in the limiting area showed more compatible results.

Also, when the amount of change in the vertical direction component of the magnetic force of the S2 pole (restriction pole) is set to at most 0.5)(mT/°, particularly favorable results in the evaluation of the congestion in the limiting area were obtained because the developer could stably move in the recesses 50.

Note that for each of the above experiments, a gap (blade gap) between the layer-thickness limiting member 232 and the development roller 231 was adjusted. Thus, when similar evaluations were carried out within a range from 100 g/m$^2$ to 500 g/m$^2$ of developer conveyance on the sleeve 231B, similar results were obtained. Additionally, when evaluations similar to the above were carried out in a range of toner density from 5% to 12%, similar results were obtained. Additionally, even when similar evaluations were carried out on a development roller 231 with a diameter from 12 mm to 35 mm, similar results were obtained.

Details of the developing device 23 and the image forming apparatus 10 including the same according to an embodiment of the present disclosure are described above. It is possible to stably supply toner with an ensured charge amount to the photosensitive drum 20, and a stabilized image can be formed according to this image forming apparatus 10. Note that the present disclosure is not limited hereto. The present disclosure can be implemented in a form of the following variations, for example.

Figure 8:
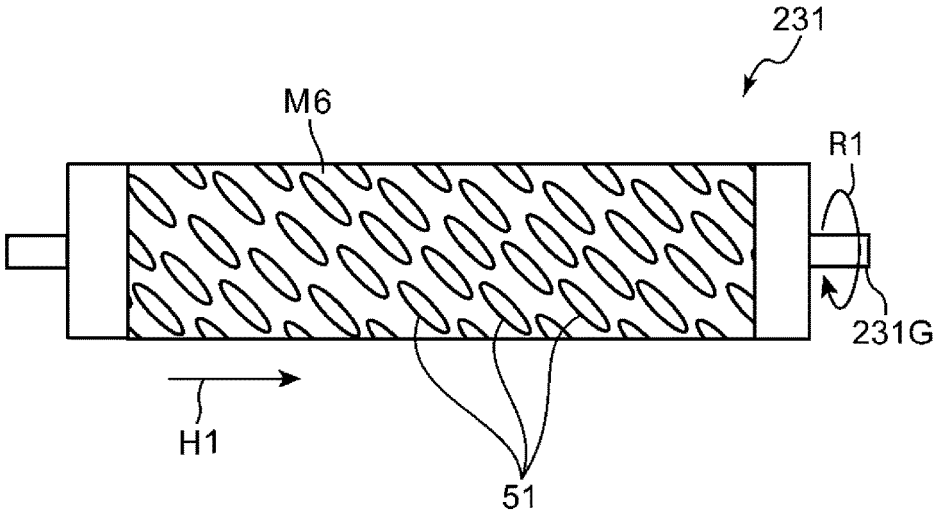
FIG. 8 is a schematic front view of the sleeve of the development roller according to a variation of the embodiment of the present disclosure.

(1) In the above embodiment, an example is described in which the recesses 50 are formed on the sleeve 231B of the development roller 231 as illustrated in FIG. 3, but the present disclosure is not limited hereto. FIG. 8 is a schematic front view of a sleeve of the development roller 231 according to a variation of the above-mentioned embodiment of the present disclosure. In FIG. 8, ends of adjacent recesses 51 are arranged in the axial direction of the development roller 231 (first conveyance direction H1) so as to overlap each other. In detail, each of the recesses 51 has a downstream end and an upstream end in the first conveyance direction H1, and among the recesses 51, the downstream end of each recess is located farther downstream in the first rotational direction R1 than the upstream end of an adjacent recess 51 in the first conveyance direction H1. Even in a situation like this, the developer in the recesses 51 can easily move in the extending direction because the areas M are formed on the sleeve.

(2) In the above embodiment, the developing device 23 is described as including a single development roller, but the present embodiment is not limited hereto. Another development roller may be further interposed between the development roller 231 and the first screw 233A in FIG. 3. Also, the plurality of development rollers may be arranged opposite to the photosensitive drum 20.

What is claimed is:

1. A developing device, comprising:

a housing configured to house developer including toner and magnetic carrier;

a development roller configured to supply the toner to a photosensitive drum, the development roller including:

a fixed magnet fixed to the housing; and a sleeve configured to rotate in a predetermined rotational direction around the fixed magnet and carry the developer on a surface of the sleeve;

a first conveyance member arranged opposite to the development roller in the housing and configured to convey the developer in a first conveyance direction; and a layer-thickness limiting member arranged opposite to the sleeve in the housing and configured to limit thickness of the developer that is carried by the sleeve, wherein the sleeve includes a plurality of recesses on a peripheral surface thereof, and the recesses are arranged in predetermined intervals in circumferential and axial directions of the sleeve, each of the recesses has an elongated shape, and each of the recesses has a downstream end and an upstream end in the first conveyance direction, and the downstream end is located farther downstream in the rotational direction of the sleeve than the upstream end.

2. The developing device according to claim 1, wherein an angle θ is within a range of $45° \leq \theta < 85°$, the angle θ being an angle between a standard plane and an extending direction in which each recess extends on the peripheral surface of the sleeve, the standard plane being orthogonal to an axial direction of the development roller.

3. The developing device according to claim 2, wherein the angle θ between the standard plane and the extending direction on the peripheral surface of the sleeve is within a range of $60° \leq \theta < 80°$.

4. The developing device according to claim 1, wherein the fixed magnet includes a restriction magnetic pole that is arranged opposite to the layer-thickness limiting member, and an amount of change in a vertical direction component of magnetic force of the restriction magnetic pole is at most 0.5 (mT/°), the change being in an area from a side of the layer-thickness limiting member that is upstream in the rotational direction of the sleeve to a point that is 10° farther upstream in the rotational direction.

5. The developing device according to claim 1, wherein among the recesses, the downstream end of each recess is located farther downstream in the rotational direction of the sleeve than the upstream end of an adjacent recess in the first conveyance direction.

6. An image forming apparatus, comprising:

the developing device according to claim 1;

the photosensitive drum configured to be supplied with the toner from the development roller and carry a toner image on a surface thereof; and a transfer section configured to transfer the toner image from the photosensitive drum to a sheet.

* * * * *